US006893183B2

(12) United States Patent
Levison

(10) Patent No.: US 6,893,183 B2
(45) Date of Patent: May 17, 2005

(54) IMPLEMENTS FOR CLEANING, POLISHING OR SANDING

(75) Inventor: Barrie Abram David Levison, St. Albans (GB)

(73) Assignee: Easy-Do Products Limited, London (GB)

( * ) Notice: Subject to any disclaimer, the term of this patent is extended or adjusted under 35 U.S.C. 154(b) by 0 days.

(21) Appl. No.: 10/432,299

(22) PCT Filed: Nov. 23, 2001

(86) PCT No.: PCT/GB01/05173

§ 371 (c)(1),
(2), (4) Date: May 21, 2003

(87) PCT Pub. No.: WO02/41745

PCT Pub. Date: May 30, 2002

(65) Prior Publication Data

US 2004/0028457 A1 Feb. 12, 2004

(30) Foreign Application Priority Data

Nov. 24, 2000 (GB) ..... 0028687
Jun. 14, 2001 (GB) ..... 0114498

(51) Int. Cl.[7] ..... A46B 11/00; B43K 5/00

(52) U.S. Cl. ..... 401/290; 401/205; 401/206; 401/272

(58) Field of Search ..... 401/290, 263, 401/205, 206, 270, 272, 273, 264

(56) References Cited

U.S. PATENT DOCUMENTS 729,515 A * 5/1903 Steele ..... 401/273
3,653,779 A * 4/1972 Schwartzman ..... 401/206
3,661,468 A * 5/1972 Schwartzman ..... 401/206
3,805,990 A 4/1974 Palaudarias
4,101,053 A * 7/1978 Mast, Jr. ..... 221/232
4,826,340 A * 5/1989 Rothweiler et al. ..... 401/279
5,120,148 A * 6/1992 Waters et al. ..... 401/264

FOREIGN PATENT DOCUMENTS

EP 0 161113 A2 11/1985
EP 0 161 907 * 11/1985 ..... A46B/11/04
GB 141183 4/1920
WO WO 02/41745 A1 5/2002

OTHER PUBLICATIONS

Copy of International Search Report, Apr. 04, 2002.
International Preliminary Examination Report, Jan. 02, 2003.

* cited by examiner

*Primary Examiner*—David J. Walczak
(74) *Attorney, Agent, or Firm*—Bradley N. Ruben

(57) ABSTRACT

An implement for cleaning, polishing, sanding or other rubbing action which comprises a hollow handle (2) adapted to accommodate a cleaning fluid, polish, lubricant or other fluid and having a head (1) to which the fluid may be dispensed from the handle (2) through a dispensing aperture (6), the head (1) comprising a cleaning or polishing pad or brush or the like (11), the implement having a fluid dispensing flow regulating means comprising a plunger (5) which in use projects from the head (1) through the dispensing aperture (6) and into the hollow interior of the handle (2), the plunger (5) being operated by pressing the head against a surface to advance the plunger (5) to open up the dispensing aperture (6) for dispensing of the fluid, wherein the head (1) is mounted to the handle (2) in such a way as to bend and thereby pre-stress a resiliently flexible part (4) of the head (1) from which the plunger (5) projects to resiliently bias the plunger (5) to retract and occlude the dispensing aperture (6).

15 Claims, 5 Drawing Sheets

IMPLEMENTS FOR CLEANING, POLISHING OR SANDING

FIELD OF THE INVENTION

The present invention concerns improvements in and relating to implements for cleaning, polishing, or sanding of the type having a hollow handle and a cleaning, polishing or sanding head in which a suitable fluid is held within the hollow handle and dispensed to the head in use.

BACKGROUND TO THE INVENTION

Implements of the aforementioned type for the purposes of cleaning or polishing exist in a variety of different forms and may have heads that range from soft sponges to brushes or scouring pads.

With such implements that have a working head formed of foam or sponge the foam or sponge will generally draw the fluid (e.g. detergent) from within the hollow handle and on to the outer surface of the working head by the suction effect of the sponge/foam expanding after it has been depressed and then released. Implements with this simple means for delivery of the fluids to the head are widespread but they do suffer from leakage of the fluid under gravity and capillary action and have their efficiency limited by the resilience of the foam and the airtightness of the storage volume of the hollow handle.

By contrast, other implements of the type in question have integral mechanisms to control the dispensing of the stored fluid to the head. In these mechanisms the pressing of the head against a surface to be cleaned causes part of the head to flex and move a plunger to open a dispensing aperture to allow the dispensing of fluid. These existing mechanisms are, however, reliant upon a pre-defined moulded curvature of the head to allow for the flexing that displaces the plunger. The extent of curvature/flexure cannot be adjusted and the resilient return force to move the plunger to close the aperture is generally weak and worse still, the area over which the head can be depressed to move the plunger is very small, being limited to a zone closely overlying the plunger.

It is a general objective of the present invention to provide an implement that overcomes some or all of the drawbacks of the aforementioned prior art and which is versatile and cost efficient to manufacture. It may suitably be used for such alternative activities as sanding or polishing, having an appropriate head and containing an appropriate fluid.

A further general objective of the present invention is to provide an implement having a working head mounted to a handle where the head has its working surface, for cleaning, polishing, sanding or the like, adjustable in contour simply and efficiently.

SUMMARY OF THE INVENTION

An implement for cleaning, polishing, sanding or other rubbing action which comprises a hollow handle adapted to accommodate a cleaning fluid, polish, lubricant or other fluid and having a head to which the fluid may be dispensed from the handle through a dispensing aperture, the head comprising a cleaning or polishing pad or brush or the like, the implement having a fluid dispensing flow regulating means comprising a plunger which in use projects from the head through the dispensing aperture and into the hollow interior of the handle, the plunger being operated by pressing the head against a surface to advance the plunger to open up the dispensing aperture for dispensing of the fluid, wherein the head is mounted to the handle in such a way as to bend and thereby pre-stress a resiliently flexible part of the head from which the plunger projects to resiliently bias the plunger to retract and occlude the dispensing aperture.

The arrangement of the present invention gives a strong resilient return force to the plunger and enables it to be activated by pressing the head over substantially any part of its front surface and not simply directly over the plunger.

The head preferably has first mounting means at a first position thereon and a second mounting means at a second position thereon spaced from the first mounting means and the handle has complementary first mounting means and second mounting means thereon to co-operatively engage respectively, with the first mounting means and the second mounting means of the head, the first mounting means and the second mounting means of the head being spaced apart by a greater distance than the distance by which the complementary first mounting means and second mounting means of the handle are spaced apart, thereby necessitating bending and pre-tensioning of the resiliently flexible part of the head to enable the head to be mounted to the handle.

The resiliently flexible part of the head is suitably a flexible backing plate to which a working part—e.g. pad or bristles is/are fastened. This gives a great economical versatility in the provision of different heads for a common plunger part and handle.

One or more alternatively selectable complementary mounting means are suitably provided on the handle at a differing spacing from the first complementary mounting means to enable selection of the extent of resilient bending of the resiliently flexible part of the head.

Preferably the plunger is partially collapsible to enable it to be forced through the dispensing aperture and, if necessary, subsequently withdrawn therefrom and the mounting means of the head and complementary mounting means of the handle are disengageable to enable the head to be removed and replaced with another head.

The plunger is advantageously formed with a notch to enable it to resiliently partially collapse.

Preferably the resiliently flexible backing plate is a substantially flat plate, when not mounted to the handle.

According to a second aspect of the present invention there is provided an implement having a working head mounted to a handle where the handle has its working surface for cleaning polishing, sanding, or the like, adjustable in contour, wherein the head has first mounting means at a first position thereon and a second mounting means at a second position thereon spaced from the first mounting means and the handle has complementary first mounting means and second mounting means thereon to co-operatively engage respectively, with the first mounting means and the second mounting means of the head, the first mounting means and the second mounting means of the head being spaced apart by a greater distance than the distance by which the complementary first mounting means and second mounting means of the handle are spaced apart, thereby necessitating bending and pre-tensioning of the resiliently flexible part of the head to enable the head to be mounted to the handle.

BRIEF DESCRIPTION OF THE DRAWINGS

Preferred embodiments of the present invention will now be more particularly described by way of example, with reference to the accompanying drawings, wherein:

FIG. 3 is a view similar to FIG. 1 and part sectional to show the open state of the fluid dispensing flow regulating means and the manner of attachment at the head to the handle, while

DESCRIPTION OF THE PREFERRED EMBODIMENT

Referring firstly to FIGS. 1–7 these illustrate a first preferred embodiment of the invention which comprises a dish cleaning implement having a working head that is suitably a foam pad and which may have an abrasive nature or not depending on the nature of the articles to be cleaned. The working head 1 comprising the pad 10 is detachably mounted to the working end of an elongate hollow handle 2, having an end cap 3, which handle serves as a vessel for storage of, in this case, detergent (washing up liquid). The end of the handle 2 remote from the working head 1 has a screw-threaded cap that is removable to refill with the detergent.

As can be seen from the more detailed illustrations in FIGS. 3 to 7, the head 1 mounts to the end of handle 2 by an articulated mounting, i.e. a mounting that allows a degree of freedom of movement of the head 1 on the handle 2 as will be explained below.

Figure 5A:
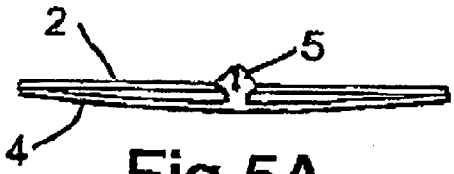
FIGS. 5A and 5B are simplified views of the operation of the dispensing fluid flow regulating means.
Figure 6:
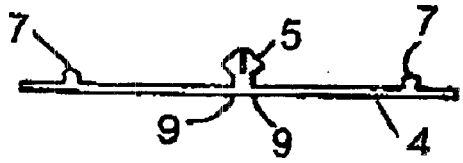
FIG. 6 is a sectional view of the flat flexing back plate of the head that forms part of the dispensing flow regulating means.
Figure 7:
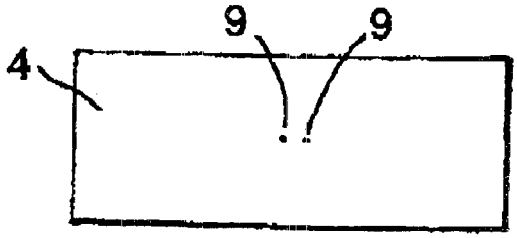
FIG. 7 is a plan view from below of the flexing plate that forms part of the dispensing flow regulating means.

The pad 10 is moulded, adhered or otherwise fastened to a flexible back plate 4 that may suitably be formed of a sheet of plastics material and which is suitably substantially flat as illustrated in FIGS. 5–7 but which is bowed/flexed into an arched form as it is mounted to the working end of the handle 2. The initial flatness of the back plate 4 makes it cheap and easy to manufacture and easy to adhere the pad 10 to back plate 4. The subsequent flexing of the plate 4 and associated pad gives an extremely effective way of introducing a curvature into the working face of the pad 10 that that cannot readily and economically be achieved in pad manufacture.

The back plate 4, as it bows, does so resiliently, its natural tendency being to move back to a relatively flattened configuration. This resilience is exploited to provide a force for regulation of the flow of the detergent fluid to be dispensed from the hollow handle through to the head 1.

The backing plate 4 has projecting from its rear face a plunger element 5 that in use, when the pad 1 is mounted to the handle 2, protrudes through a dispensing aperture 6 of the handle 2.

The plunger projection 5 has a relatively narrow neck portion that terminates in a larger head portion. The head portion is compressible to be able to be forced through the dispensing aperture 6 when mounting the working head 1 to the handle 2 and resiliently regains its shape within the chamber of the hollow handle 2 so that it cannot be withdrawn back through the dispensing aperture 6 without application of a deliberate pulling force such as would only be applied when seeking to remove the head for replacement. Furthermore, the head of the plunger projection 5, being larger than the dispensing aperture 6 will, under a retracting force, seat against the dispensing aperture 6 to occlude the aperture 6.

In the illustrated embodiment, the head portion of the plunger 5 is notched to assist in its resilient compression to fit through the dispensing aperture 6.

The retracting force that causes the plunger 5 head to seat against and occlude the dispensing aperture 6 is provided by the resilient restorative force of the arched backing plate 4 of the head 1 and this restorative force is primarily induced by the act of bending the plate 4 to enable it to mount to the working end of the handle 2.

Figure 1:
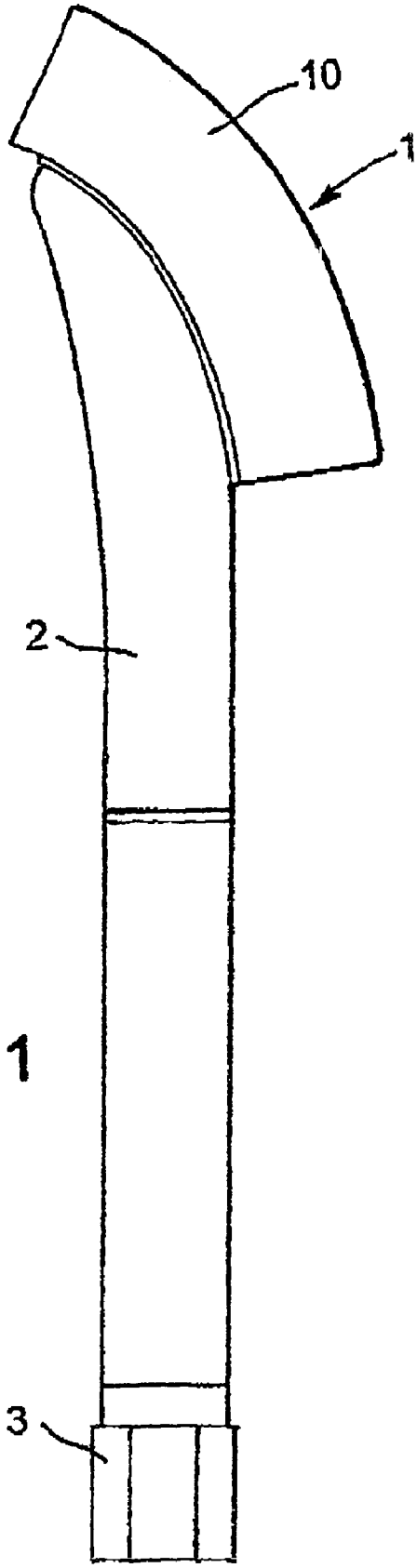
FIG. 1 is a side elevation view of a dish cleaning implement having a foam pad head.
Figure 2:
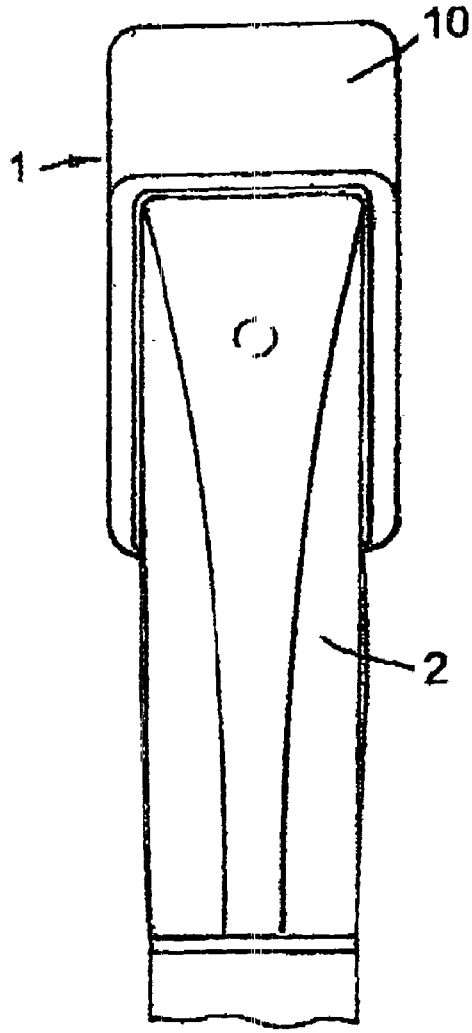
FIG. 2 is a plan view of the working end of the implement.
Figure 3:
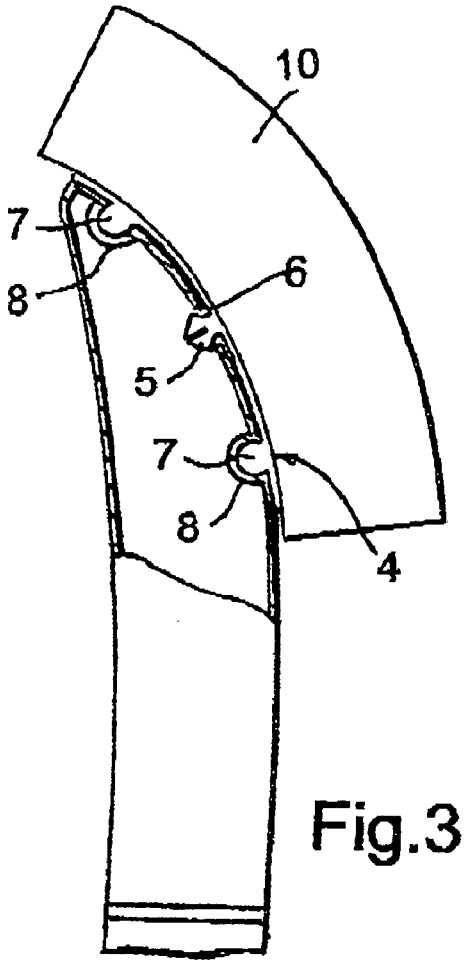
Figure 4:
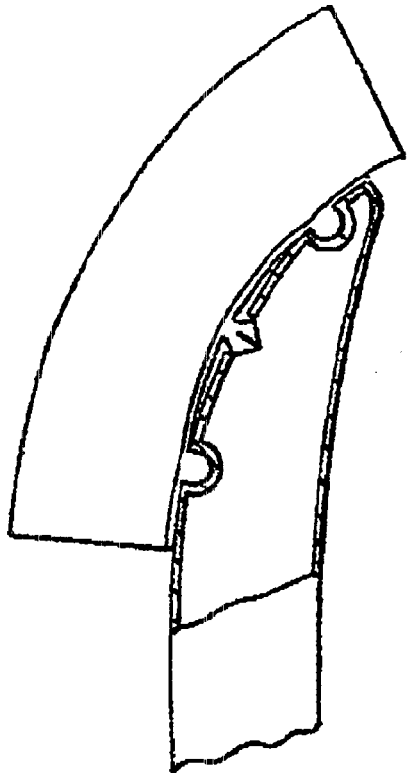
FIG. 4 is a similar view but with the fluid dispensing flow regulating means in closed state.

Referring to FIGS. 3, 4 and 6, it will be seen that the backing plate 4 is provided with spaced apart mounting lugs 7 that are adapted to be co-operatively engaged with corresponding spaced apart mounting sockets 8 formed at the working end of the handle 2.

Importantly, the distance separating the mounting sockets 8 is less than the distance separating the mounting lugs 7 of the backing plate 4 when the backing plate 4 is in its suitably substantially flat natural rest configuration and hence the backing plate 4 is necessarily bowed when it is mounted to the handle 2 and thereby pre-stressed to give the required resilient restorative force to retract the plunger 5 for occluding the dispensing aperture 6.

Figure 5B:
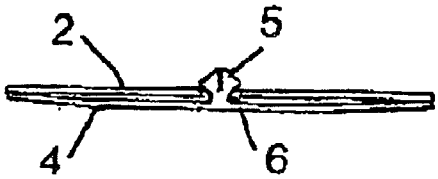

The two extreme positions of the backing plate 6 in use as illustrated in FIGS. 5A and 5B. FIG. 5A shows the bowed and pre-stressed backing plate 4, as mounted to the handle 2 but prior to use or following use and showing that the plunger head is seated against the dispensing aperture 6 to occlude it.

FIG. 5B shows the position of the backing plate 4 when the pad 10 of the working head of the implement is pressed against a dish or other item to be cleaned. The act of pressing the backing plate 4 depresses it against the working end of the handle 2 and moves the plunger 6 head further into the interior of the handle 2, thereby freeing the annular opening between the plunger 5 head and the circular dispensing aperture 6. This enables the detergent to pass from the storage volume within the handle 2 through the dispensing aperture 6 and through small apertures 9 in the backing plate 4 to emerge out on to the pad 10. The subsequent lifting of the head 1 of the cleaning implement away from the dish then allows the restorative force of the bowed backing plate 4 take effect, retracting the plunger 5 and ultimately closing the dispensing aperture 6 but simultaneously effectively pumping further fluid out through the aperture 6 as it closes.

Figure 8:
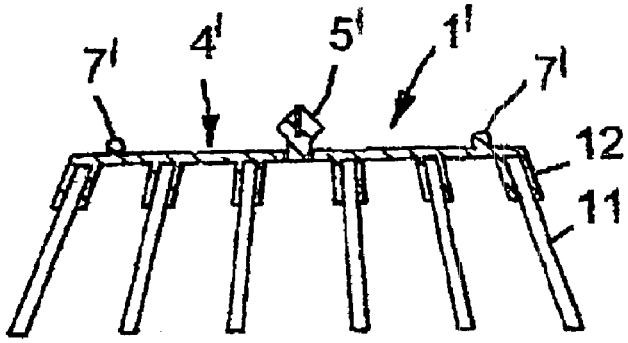
FIG. 8 is a sectional view of an alternative embodiment of head comprising a brush.

Turning to FIG. 8, this illustrates an alternative head 1, for the implement, shown in simplified form, and comprising a brush head. This brush head 1', has a flexible backing plate 4', again formed with a plunger 5', and mounting lugs 7', for mounting to the handle 2. It can, therefore, readily be inter-changeably mounted to the handle 2 in replacement of the foam pad head 1'. It too is pre-stressed by bending it as it is fitted to the handle to enable the lugs 7', to mount It to the mounting apertures 8 of the handle 2.

The bristles/hairs 11 of the brush head 1, are shown as being fitted within respective socket extensions 12 of the front face of the backing plate 4'. The deep socket extensions 12 on the backing plate 4 allow the bristles 11 to be inserted using the standard, cheap, drill and staple method, but without the additional plastics material that is normally used to create a standard depth over the whole area to be bristled. Thus effecting a considerable saving in raw material.

The gaps between the socket extensions 12 also allow the backing plate 4 to remain flexible, allowing the plate 4 to form a curved profile thereby allowing the flexing attachment and valve operation to work.

No other brush head has used this material saving design.

Figure 15:
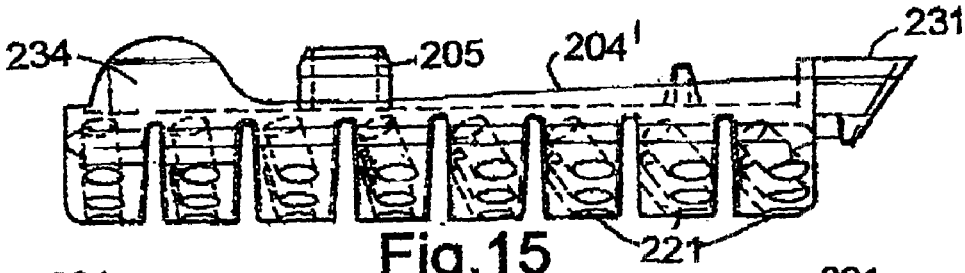
FIGS. 15 and 16 are, respectively, a side elevation view and plan view of a bristle mounting backing plate for the FIG. 11 embodiment.
Figure 16:
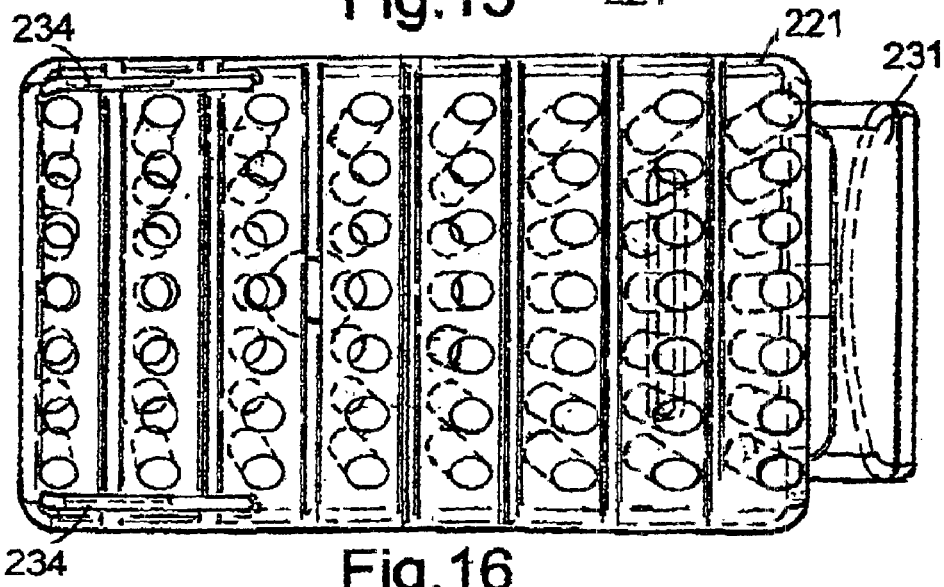

Although the socket extension 12 may be tubular and configured with an individual extension 12 for each bristle 11, the preferred configuration of extension is as a rib-like extension 221 extending laterally of the backing plate 4 (see embodiment of FIGS. 15 and 16) and accommodating a row of bristle sockets.

In an alternative embodiment the bristles or hairs 11 could be embedded in a base member that is adhered or otherwise fastened to a substantially universal backing plate 4, to which a range of alternative working elements such as foam pads, brush means or sanding means may be fastened thereby even further reducing manufacturing costs while meeting demand for a diversity of implements.

Figure 9:
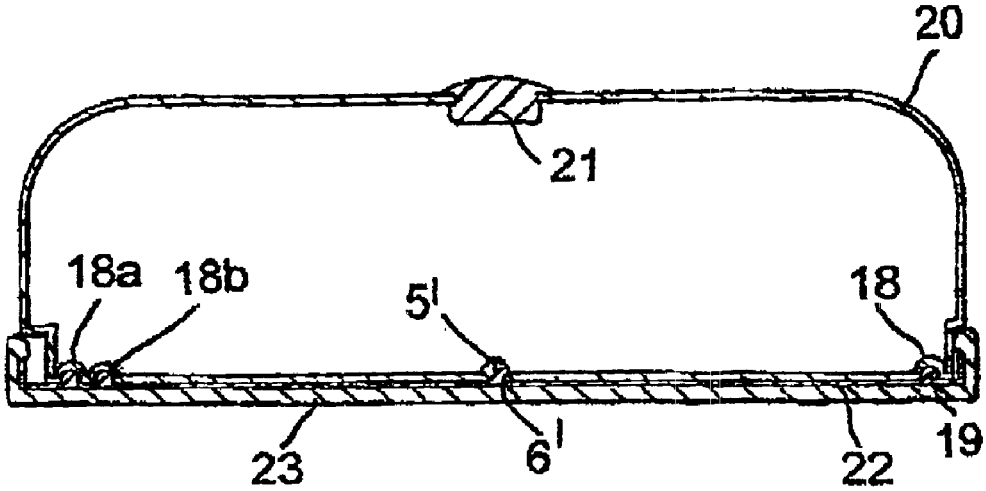
FIGS. 9 and 10 are, respectively, transverse sectional views of a sanding implement embodying the invention firstly with the fluid dispensing flow regulating means in open state and secondly with it in the enclosed state.
Figure 10:
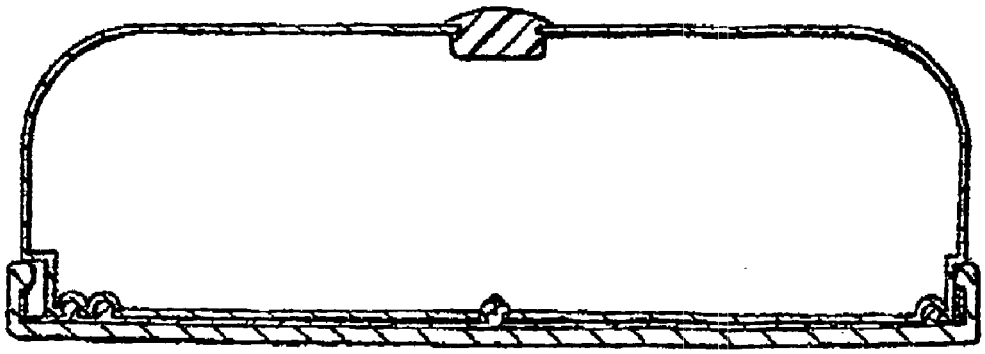

Turning to FIGS. 9 and 10, these illustrate a substantially different shape of implement that embodies the invention. These figures show a sanding "block" that is adapted for wet sanding by dispensing water or another suitable lubricant from the storage volume defined by the hollow block-shaped handle 20.

The block-shaped handle 20 is broadly the same as the hollow elongate handle 2 of the first embodiment and has a removable cap 21 to allow refilling and a working face provided with mounting sockets 18 to receive corresponding mounting lugs 19 formed on the flexible "backing" plate 22. On its front face, the backing plate 22, carries a substantially flat sanding implement 23 that is shown as also co-operatively engaged at each end with the handle 20.

As with the earlier described embodiments, however, the sanding element 23, need not engage with the handle 20 other than through intermediacy of the backing plate 22 but conforms to the shape of the arched backing plate 22 and moves with the backing plate 22 when pressed against a surface to be sanded.

A particularly important aspect of the invention that is apparent from the embodiment of FIGS. 9 and 10 is the provision of alternative mounting sockets 18*a*, 18*b* at one end of the handle 20, that enable the user to selectively adjust the extent to which the backing plate 22 is arched when mounted to the handle 20. In the first position of attachment mounting socket 18*a* the arch of the backing plate 22 will be at its most shallow whereas at the second mounting position defined by mounting socket 18*b* the backing plate 22 will be relatively more arched.

This facility can be used for two purposes—namely, to provide a means for increasing or decreasing the resilient return force of the backing plate 22 pulling the plunger 5, to seat back against the dispensing aperture 6, and/or to enable selection of the arched contour of the working surface of the implement to better suit the nature of the items being worked upon. In the case of a sanding implement, the adjustability of the contour of the working face of the sanding implement may prove particularly useful for sanding correspondingly contoured surfaces of objects.

Although the sander embodiment of the invention is shown as having a particular form in FIGS. 9 and 10 it could, in principle, have a very similar form to the dish-cleaner embodiment of FIGS. 1 to 4. Furthermore, the facility for providing alternative points of mounting on the handle 2 to adjust the extent of arching of the backing plate 4 can, of course, also be used in the dishwasher embodiment of the FIG. 1.

With reference to FIGS. 11–15, the illustrate a second embodiment of dish cleaning implement that operates in generally the same manner as the first embodiment but differs in having a different configuration of fluid flow regulating means and a different configuration for attachment of the working head to the handle.

Figure 11:
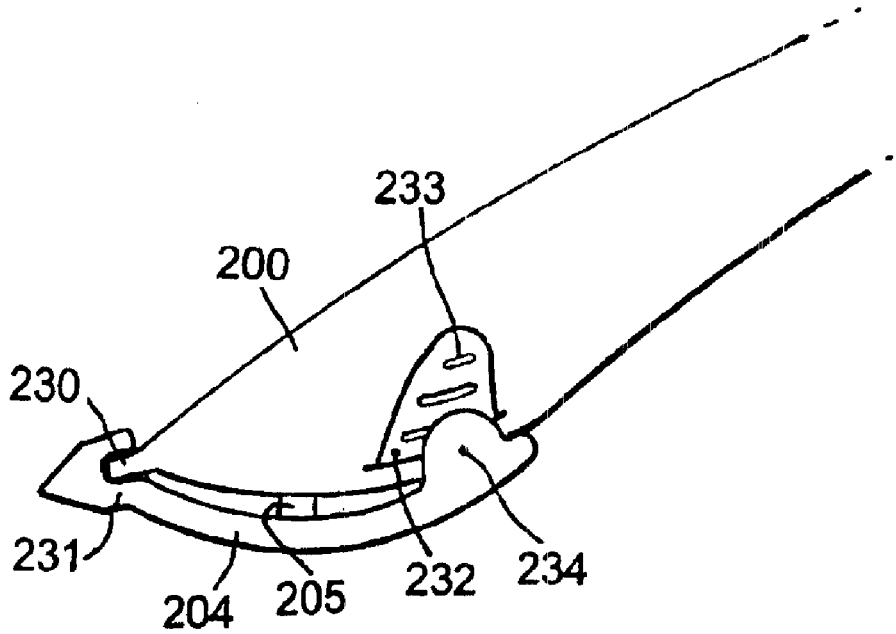
FIG. 11 is a side elevation view of a second embodiment of a dish cleaning implement.

As can be seen from FIG. 11, the handle 200 of the dish cleaning implement co-operatively engages with the backing plate 204 of the working head by means of a shoe or socket 231 at one end of the backing plate 204 fitting over a protrusion 230 at the front end of the handle 200. By slight flexing of the backing 204 a pair of wing-shaped clips 234 one on each side at the rear end of the backing plate 204 may be manipulated into engagement with corresponding recesses 232 provided in either side of the handle 200 and each clip over a rib 233 within the corresponding recess 232. Each of the recesses 232 has a plurality of alternative clip engagement ribs 233 arranged one above another to give a range of options for attachment of the clip 234 to adjust the extent of separation between the underside of the handle 200 and the opposing face of the backing plate 204. This enables stepped adjustment of the operating displacement of the backing plate 204 and can be used to adjust the volume of liquid dispensed in use.

The ribs 233 extend substantially parallel to the longitudinal axis of the backing plate 204. The clips 234 when mounted in one or other of their corresponding slots 233 have some degree of freedom of movement to slide along the ribs 233 and which gives the central portion of the backing plate 204 a useful freedom of movement to flex toward and away from the handle 200. Furthermore, there is a greater degree of freedom of movement of the central portion of the backing plate 204 laterally of the handle 200. The greater freedom of movement of the backing plate 204 central portion relative to the underside of the handle 200 allows for easier flexing of the backing plate 204 in operation, facilitating depression of the plunger 205 by pressing at a wider range of points across the area of the backing plate 204. It is also particularly suitable where it is desired to make the backing plate 204 of harder material that does not flex as easily when fixed at both ends.

Figure 12:
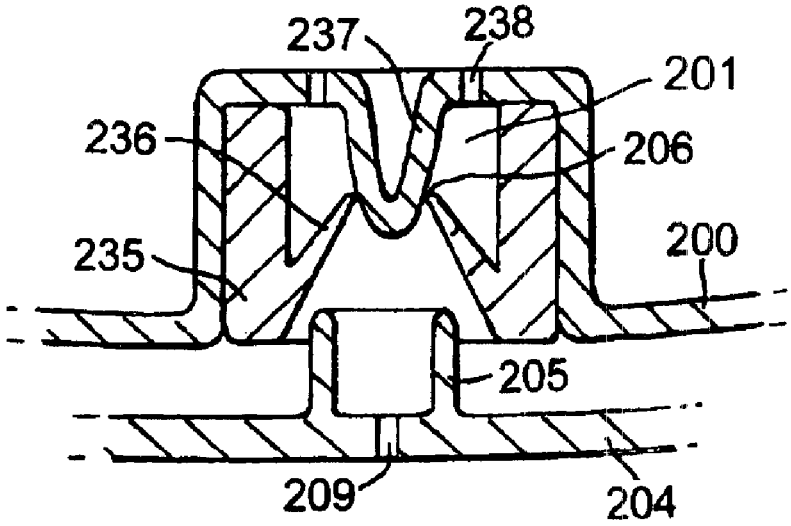
FIG. 12 is a sectional view of a valve mechanism of the FIG. 11 embodiment.
Figure 13:
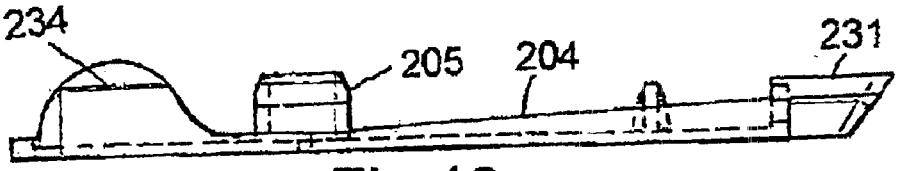
FIGS. 13 and 14 are, respectively, a side elevation and plan view of a foam pad mounting backing plate for the FIG. 11 embodiment.
Figure 14:
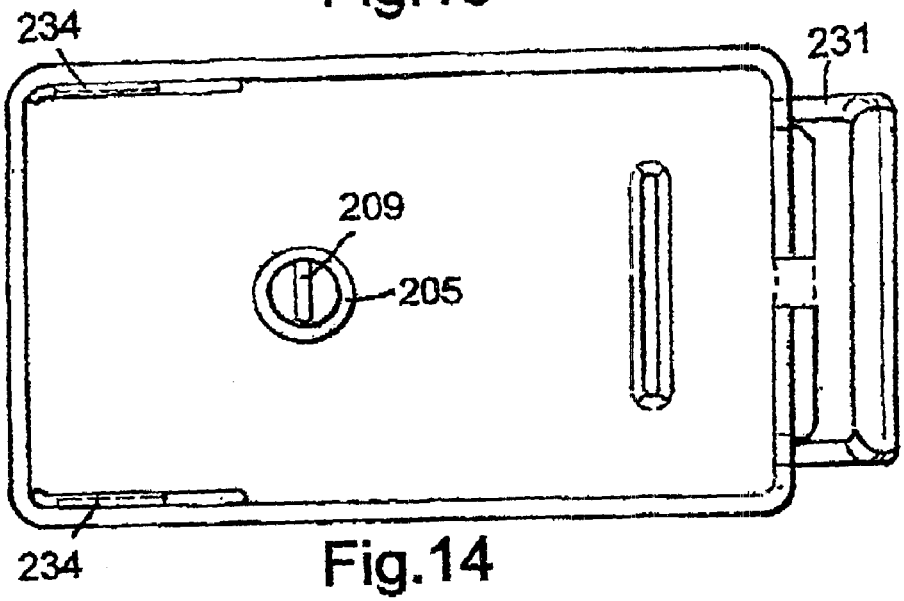

In this second embodiment of the dish-cleaning implement and as best illustrated in FIG. 12, the fluid flow regulating means has been enhanced over the first illustrated embodiment to incorporate an automatic sealing functionality. Here the hollow interior of the handle 200 comprises an antechamber 201 formed as a recess in the underside of the handle 200. An annular elastomeric sealing component 235 is seated as a friction fit within the recess. This elastomeric component 235 has a radially inner thin-sectioned lip portion 236 which surrounds and when at rest resiliently presses against and seals against a central raised portion 237 of the recess. This lip portion 236 suitably has a generally conical shape directed into the recess, as illustrated. The leading edge of the lip 236 defines the dispensing aperture 206 for dispensing the fluid. As can be seen, the antechamber 201 is in direct fluid communication with the main cleaning fluid storage volume within the handle 200, via apertures 238.

The cleaning fluid is released through the dispensing aperture 206 defined by the lip 236 of the elastomeric member 235 only when it is pushed radially outwardly away from its closing and sealing contact with the raised central portion 237 of the recess by the insertion of the plunger 205. In this embodiment the plunger 205 is tubular in shape and with an internal diameter greater than the external diameter of the raised portion 237 of the recess.

When the plunger 205 protrudes through the dispensing aperture 206 defined by the lip 236 and into the antechamber 201 of the hollow interior of the handle 200, the cleaning fluid flows from the antechamber 201 and out through the dispensing aperture 206 into the annular cavity in the tubular plunger 205 created between the external diameter of the raised floor protrusion 237 of the recess and the internal diameter of the plunger 205 tubular walls, and finally passing to the working surface of the backing plate 204 via a central aperture 209 through the backing plate 204 and which meters the flow to the working surface of the backing plate 204. The aperture 209 allows a controlled extended duration of cleaning fluid delivery for each depression of the backing plate 204.

The permanent and self contained nature of this occluding arrangement has the advantage that the liquid remains totally contained even when the detachable head is not present, e.g. when changing cleaning heads or for safe transit.

It will be apparent from the foregoing that numerous alternative embodiments of the invention are conceivable within the scope of the invention and achieve substantial benefits over the prior art implements. The implements of the present invention are significantly more efficient and economical to manufacture and versatile than the existing implements.

I claim:

1. An implement for cleaning, polishing, sanding or other rubbing action which comprises a hollow handle adapted to accommodate a cleaning fluid, polish, lubricant or other fluid and having a head to which the fluid may be dispensed from the handle through a dispensing aperture in fluid communication with the hollow, the head having a periphery and comprising a cleaning or polishing pad or brush or the like, the implement having a fluid dispensing flow regulator comprising a plunger projecting from the head and cooperating with the dispensing aperture, the plunger being operated by pressure from a surface against the head to advance the plunger to open up the dispensing aperture for dispensing of the fluid and release of said pressure causing retraction of the plunger to close the aperture, wherein the head is mounted to the handle at areas of the head periphery and otherwise the periphery is free, including two mountings being provided as a pair of mountings on opposite sides of the handle, the head being mounted effective to provide a freedom of movement at the mounting effective to allow resilient flexing of the head toward and away from the handle and also to flex the head so as to normally bias the plunger to retract and close the dispensing aperture.

2. An implement as claimed in claim 1, wherein the pair of mountings comprises a first pair of means on the head cooperating with a second pair of means on the handle, and the first pair of means are spaced apart from each other by a greater distance than the distance by which the second pair of means on the handle are spaced apart from each other, thereby necessitating bending and pre-tensioning of the resiliently flexible part of the head to enable the head to be mounted to the handle.

3. An implement as claimed in claim 2, wherein the manner of engagement of the mounting means of the head with the mounting means of the handle is configured to allow a degree of freedom of the head to move at the mounting and also lateral freedom of movement of the head relative to the handle with respect to the longitudinal axis of the handle.

4. The implement of claim 2, wherein the handle comprises at least one additional pair of means alternatively selectable for complementary mounting to said first pair of means on the head, said second and at least one additional pairs of means on the handle present at different spacings.

5. An implement as claimed in claim 1 wherein the head includes a resiliently flexible backing plate and a working part.

6. An implement as claimed in claim 5 wherein the resiliently flexible backing plate is a substantially flat plate, when not mounted to the handle.

7. An implement as claimed in claim 5 wherein the flexible working part is a pad.

8. An implement as claimed in claim 5 wherein the flexible working part is bristles thereon or fastened thereto.

9. An implement for cleaning, polishing, sanding or other rubbing action which comprises a hollow handle adapted to accommodate a cleaning fluid, polish, lubricant or other fluid and having a head to which the fluid may be dispensed from the handle through a dispensing aperture, the head comprising a cleaning or polishing pad or brush or the like, the implement having a fluid dispensing flow regulating means comprising a plunger which in use projects from the head through the dispensing aperture and into the hollow interior of the handle, the plunger being operated by pressing the head against a surface to advance the plunger to open up the dispensing aperture for dispensing of the fluid, wherein the head is mounted to the handle in such a way as to bend, arching and thereby pre-stressing, a resiliently flexible part of the head from which the plunger projects to resiliently bias the plunger to retract and occlude the dispensing aperture, wherein the head has first mounting means at a first position thereon and a second mounting means at a second position thereon spaced from the first mounting means and the handle has complementary first mounting means and second mounting means thereon to co-operatively engage respectively, with the first mounting means and the second mounting means of the head, the first mounting means and the second mounting means of the head being spaced apart by a greater distance than the distance by which the complementary first mounting means and second mounting means of the handle are spaced apart, thereby necessitating bending and pre-tensioning of the resiliently flexible pert of the head to enable the head to be mounted to the handle, wherein one or more alternatively selectable complementary mounting means are provided on the handle at a differing spacing from the first complementary mounting means to enable selection of the extent of resilient bending of the resiliently flexible part of the head.

10. An implement as claimed in claim 1, wherein the head is disengageable from the handle to enable the head to be removed and replaced with another head.

11. An implement as claimed in claim 1 wherein the plunger is formed with an aperture leading to the working side of the head.

12. An implement for cleaning, polishing, sanding or other rubbing action which comprises a hollow handle adapted to accommodate a cleaning fluid, polish, lubricant or other fluid and having a head to which the fluid may be dispensed from the handle through a dispensing aperture, the head comprising a cleaning or polishing pad or brush or the like, the implement having a fluid dispensing flow regulating means comprising a plunger which in use projects from the head through the dispensing aperture and into the hollow interior of the handle, the plunger being operated by pressing the heed against a surface to advance the plunger to open up the dispensing aperture for dispensing of the fluid, wherein the head is mounted to the handle in such a way as to bend, arching and thereby pre-stressing, a resiliently flexible part of the head from which the plunger projects to resiliently bias the plunger to retract and occlude the dispensing aperture, wherein the resiliently flexible part of the head is a flexible working part, wherein the working part comprises bristles and the backing plate is initially substantially flat and has a plurality of socket head extensions extending therefrom to receive the bristles with voids between adjacent extensions whereby the material content of the backing plate to receive the bristles is economized and the backing plate may be readily flexed by flexing between the socket extensions.

13. An implement as claimed in claim 12, wherein the backing plate has a series of socket extension extrusions arranged as a series of socket extension extrusion ribs, each rib of which extends laterally of the backing plate and has a plurality of sockets to receive bristles arranged in a row in each rib.

14. An implement as claimed in claim 1 and wherein the dispensing aperture includes an elastomeric sealing component.

15. An implement as claimed in claim 14, wherein the plunger has a tubular configuration so that when advanced into the elastomeric sealing component it will act as a conduit for the fluid from within the handle to flow onto the head.

* * * * *